US010741140B2

(12) United States Patent
Lee

(10) Patent No.: US 10,741,140 B2
(45) Date of Patent: Aug. 11, 2020

(54) DRIVER IC DEVICE INCLUDING CORRECTION FUNCTION

(71) Applicant: Seung Won Lee, Buk-Gu (KR)

(72) Inventor: Seung Won Lee, Buk-Gu (KR)

( * ) Notice: Subject to any disclaimer, the term of this patent is extended or adjusted under 35 U.S.C. 154(b) by 0 days.

(21) Appl. No.: 16/313,082

(22) PCT Filed: Mar. 23, 2018

(86) PCT No.: PCT/KR2018/003426
§ 371 (c)(1),
(2) Date: Dec. 24, 2018

(87) PCT Pub. No.: WO2018/186613
PCT Pub. Date: Oct. 11, 2018

(65) Prior Publication Data

US 2019/0197980 A1 Jun. 27, 2019

(30) Foreign Application Priority Data

Apr. 7, 2017 (KR) ..... 10-2017-0045105
Apr. 7, 2017 (KR) ..... 10-2018-0023632

(51) Int. Cl.
*G09G 3/36* (2006.01)
*G09G 3/00* (2006.01)
*G09G 3/20* (2006.01)

(52) U.S. Cl.
CPC ..... *G09G 3/3685* (2013.01); *G09G 3/00* (2013.01); *G09G 3/2051* (2013.01);
(Continued)

(58) Field of Classification Search
None
See application file for complete search history.

(56) References Cited

U.S. PATENT DOCUMENTS 6,577,775 B1 * 6/2003 Li ..... G06T 5/007 358/446
8,107,123 B2 1/2012 Ono et al.
(Continued)

FOREIGN PATENT DOCUMENTS

KR 1020130036676 4/2013
KR 101696609 1/2017
(Continued)

OTHER PUBLICATIONS

Hyun et al, Kr-101696609 machine translation (Year: 2017).*
(Continued)

*Primary Examiner* — Dorothy Harris

(57) ABSTRACT

A driver IC device includes a correction function having a unit-block setting unit for dividing pixels of a display panel into preset units so as to set the same as a plurality of unit-blocks; a correction route (LUT) setting unit for setting a LUT having a plurality of sub-regions arranged in the same form in response to an arrangement of the pixels included in the unit-blocks set through the unit-block setting unit; a storage unit for storing the LUT set through the LUT setting unit, and storing respective gain values and offset values for the plurality of unit-blocks set through the unit-block setting unit; a changing unit for changing an input value (input gray) inputted to the pixels of the display panel, by using the gain values and offset values stored in the storage unit; and a correction output unit for generating a correction output value (output gray) of the pixels in the unit-blocks of the display panel by using a change value obtained through the changing unit and a coordinate value of the LUT set through the LUT setting unit.

13 Claims, 7 Drawing Sheets

(52) U.S. Cl.
CPC ..... *G09G 3/3607* (2013.01); *G09G 2320/029* (2013.01); *G09G 2320/0285* (2013.01)

(56) References Cited

U.S. PATENT DOCUMENTS

| | | | | |
|---|---|---|---|---|
| 9,123,293 | B2 | 9/2015 | Mizukoshi et al. | |
| 9,437,138 | B2 | 9/2016 | Mizukoshi et al. | |
| 2006/0214887 | A1* | 9/2006 | Ishida | G09G 3/2055 345/63 |
| 2006/0214940 | A1* | 9/2006 | Kinoshita | G09G 3/2096 345/589 |
| 2007/0013622 | A1* | 1/2007 | Stoops | G09G 3/3611 345/84 |
| 2007/0229863 | A1 | 10/2007 | Ono et al. | |
| 2011/0157209 | A1* | 6/2011 | Saito | G09G 3/20 345/589 |
| 2012/0176397 | A1 | 7/2012 | Mizukoshi et al. | |
| 2013/0021389 | A1* | 1/2013 | Odawara | G09G 3/3233 345/690 |
| 2015/0310803 | A1 | 10/2015 | Mizukoshi et al. | |

FOREIGN PATENT DOCUMENTS

| | | | |
|---|---|---|---|
| KR | 101696609 | B1 * | 1/2017 |
| WO | WO2004015978 | | 2/2004 |

OTHER PUBLICATIONS

International Search Report for PCT/KR2018/003426 dated Mar. 23, 2018.
English Abstract of KR 10-2013-0036676 2013.
English Abstract of KR 10-1696609 2014.

* cited by examiner

DRIVER IC DEVICE INCLUDING CORRECTION FUNCTION

PRIORITY

This application is a National Stage filing under 35 U.S.C. § 371 of, and claims priority via, International Application No. PCT/KR2018/003426, filed Mar. 23, 2018; pursuant to 35 U.S.C. § 119, this application also claims the benefit of earlier filing date and right of priority to Korean Patent Application Number 10-2017-0045105, filed on Apr. 7, 2017; and pursuant to 35 U.S.C. § 119, this application also claims the benefit of earlier filing date and right of priority to Korean Patent Application Number 10-2018-0023632, filed on Feb. 27, 2018. The entire content of PCT/KR20181003426 is hereby incorporated by reference. The entire content of Korean Patent Application Number 10-2017-0045105 and Korean Patent Application Number 10-2018-0023632 are hereby incorporated by reference.

BACKGROUND

The teachings in accordance with exemplary and non-limiting embodiments of this invention relate generally to a driver IC device, and more particularly, to a driver IC device including correction function configured to correct an output value of pixel by being applied to a small display panel having a plurality of pixels.

In general, a display panel displays information through a screen, and is widely used in home electric appliances. Recently, an LCD (Liquid Crystal Display) is commonly used as one example of display panels.

In general, an LCD is a display device developed to substitute a CRT (Cathode Ray Tube) used as a monitor for a TV or a computer and is widely used in industries due to advantages of ease in light weight, high quality achievement and low power consumption. Particularly, concomitant with expansion of continued demands on mobile communication terminals such as mobile phones and PDAs, markets for small display panels mounted on the mobile communication terminals are exponentially expanded.

Meantime, one of the core elements mandatorily necessary for driving of a display panel is a display driver IC device (hereinafter referred to as "driver IC device"). The driver IC device, as illustrated in FIG. 1, is a semiconductor providing a driving signal and a data to a display panel as an electric signal (multi high voltage level signal) to allow a character or an image to be displayed on a screen, and a core part necessary for display driving in various methods such as LCDs, PDPs and OLEDs. However, the conventional driver IC has simply functioned to provide a driving signal and a data to a display panel as an electric signal to allow characters or images to be displayed on a screen, and has had a limit by not providing a function of searching and correcting a defect from a plurality of pixels on a display panel.

The present invention is provided to solve the aforementioned problems, and it is an object of the present invention to provide a driver IC device including correction function configured to accurately correct an output value of a pixel within a unit-block by using respective gain values and offset values for the plurality of unit-blocks set by being divided to preset units, and a coordinate value of a correction route (LUT) having a plurality of sub-regions arranged in the same form in response to an arrangement of the pixels included in the unit-blocks.

In one general aspect of the present invention, there is provided a driver IC device including a correction function that corrects an output value of pixel by being applied to a small display panel having a plurality of pixels, comprising:

a unit-block setting unit for dividing pixels of a display panel into preset units so as to set the same as a plurality of unit-blocks;

a correction route (LUT) setting unit for setting a LUT having a plurality of sub-regions arranged in the same form in response to an arrangement of the pixels included in the unit-blocks set through the unit-block setting unit;

a storage unit for storing the LUT set through the LUT setting unit, and storing respective gain values and offset values for the plurality of unit-blocks set through the unit-block setting unit;

a changing unit for changing an input value (input gray) inputted to the pixels of the display panel, by using the gain values and offset values stored in the storage unit; and a correction output unit for generating correction output value (output gray) of the pixels in the unit-blocks of the display panel by using a change value obtained through the changing unit and a coordinate value of the LUT set through the LUT setting unit.

Preferably, but not necessarily, the change value changed through the changing unit may be a real number-type gray value and an integer-type gray value.

Preferably, but not necessarily, the real number-type gray value may be generated by adding a value in which an input value (input gray) inputted to pixels within a unit-block and gain values to the unit-block stored in the storage unit are multiplied, to an offset value to the unit-block.

Preferably, but not necessarily, the real number-type gray value may be a real number value by excluding a decimal number from the real number-type gray value.

Preferably, but not necessarily, the correction output unit may generate a correction output value (output gray) of pixel within a unit-block of display panel set using the following Equation 1, based on the change value that has changed the input value (input gray) inputted to the pixel within the unit-block through the changing unit, and a coordinate value of correction route set through the correction route setting unit.

$$OG = \begin{cases} I_{gray} + 1, (F_{gray} - I_{gray}) \times BS > (I_y \times BHS + I_x) \\ I_{gray}, (F_{gray} - I_{gray}) \times BS \leq (I_y \times BHS + I_x) \end{cases} \quad \text{[Equation 1]}$$

where, OG: correction output value (output gray), BS: entire size of unit-block, BHS: crosswise size of unit-block, $F_{gray}$: real number type gray value, $I_{gray}$: integer type gray value, $I_x$: x coordinate value of correction route, $I_y$: y coordinate value of correction route Preferably, but not necessarily, the correction route setting unit may set one correction route having a plurality of sub-regions arranged in a same shape corresponding to arrangement of a plurality of pixels included in the unit-block set through the unit-block setting unit.

Preferably, but not necessarily, the unit-block setting unit may form the plurality of unit-blocks in all the same shape (form).

The driver IC device including correction function according to the present invention has an advantageous effect in that an output value of a pixel within a unit-block can be accurately corrected by correcting an output value of pixels within a unit-block, using respective gain values and offset values for the plurality of unit-blocks set by being divided to preset units, and a coordinate value of a correction route (LUT) having a plurality of sub-regions arranged in the same form in response to an arrangement of the pixels included in the unit-blocks.

DETAILED DESCRIPTION OF THE DRAWINGS

Figure 1:
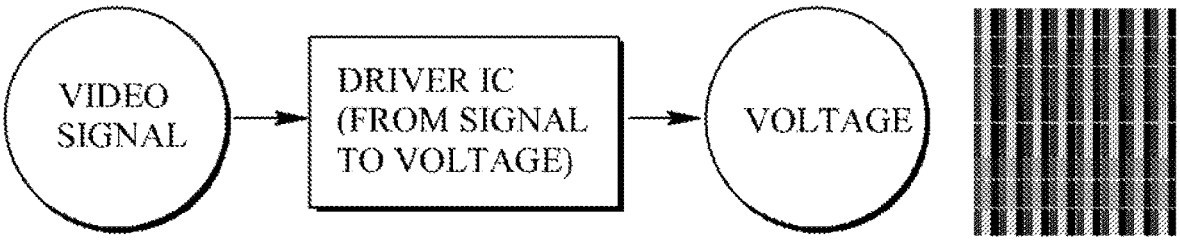
FIGURE 1 (PRIOR ART)
FIG. 1 is a schematic conceptual view illustrating a role of drive IC device according to prior art.

Some of exemplary embodiments of present invention will be described through exemplary drawings. In describing a reference numeral for each element, a same reference numeral will be designated, if possible, for the same element, albeit being differently indicated on other drawings.

In describing elements in the exemplary embodiments of the present invention, the terms, first, second, A, B (a), (b), etc., may be used. These terms may be used only to distinguish one element from another element, and the nature, order or sequence is not restricted by these terms.

When an element is referred to as being "accessed to", "coupled to," or "connected to," another element, it should be appreciated that the element may be directly accessed, connected or coupled to the other element, or intervening elements may be present therebetween.

Hereinafter, exemplary embodiments of present invention will be described in detail with reference to the accompanying drawings.

Figure 2:
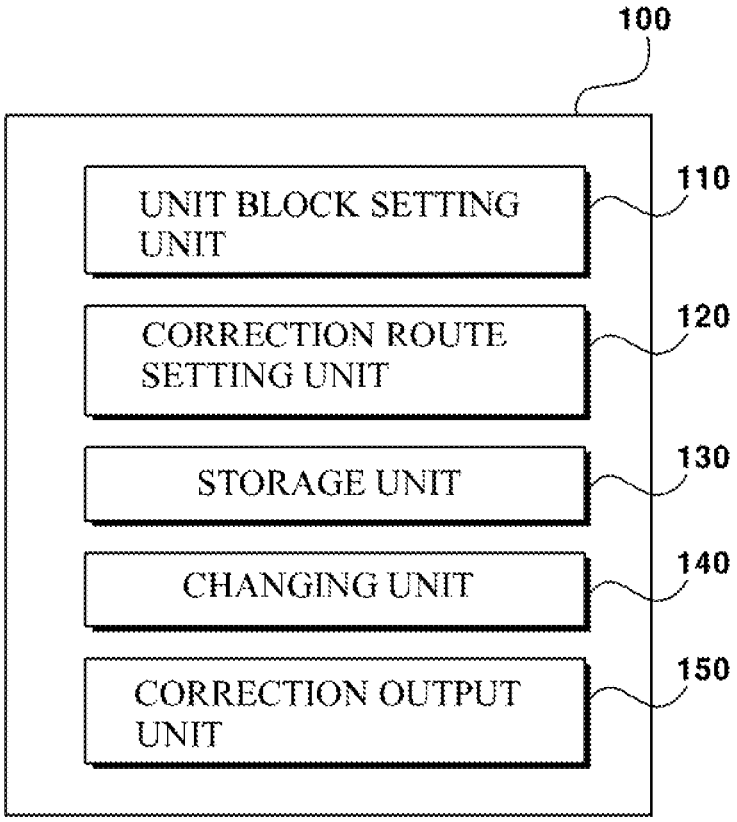
FIG. 2 is a schematic view illustrating an entire configuration of driver IC device including a correction function according to an exemplary embodiment of present invention.

FIG. 2 is a schematic view illustrating an entire configuration of driver IC device including a correction function according to an exemplary embodiment of present invention.

Referring to FIG. 2, a driver IC device (100) including a correction function according to an exemplary embodiment of present invention may be configured by including a unit-block setting unit (110), a correction route setting unit (120), a storage unit (130), a changing unit (140) and a correction output unit (150), and this configuration may enable correction of output value of pixels by being applied to a small display panel having a plurality of pixels.

Now, each element of driver IC device (100) including a correction function according to an exemplary embodiment of present invention will be described in detail.

The unit-block setting unit (110) may function to set the pixels of display panel (200) to a plurality of unit-blocks by dividing the pixels to a preset unit. To be more specific, the display panel (200) may include a plurality of pixels, and may be configured to light each pixel, where the unit-block setting unit (110) may set the plurality of unit-blocks by dividing the plurality of pixels included in the display panel (200) to a preset unit. Here, the plurality of unit-blocks set through the unit-block setting unit (110) may be formed with a same shape. For example, when the unit block is set with a 2×2 block shape, all unit blocks of display panel may be formed in a 2×2 block shape, and when the unit block is set with a 3×3 block shape (form), all unit blocks of display panel (200) may be formed in a 3×3 block shape. Hereinafter, setting of unit blocks in the unit-block setting unit (110) will be described in more detail with reference to FIG. 3.

Figure 3:
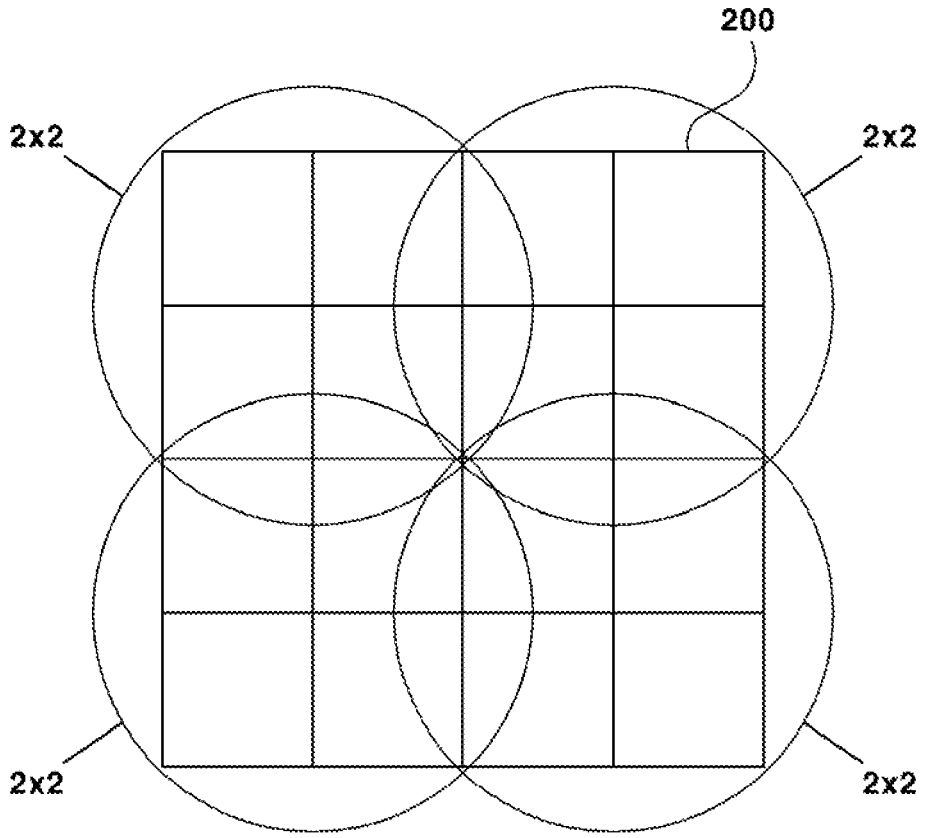
FIG. 3 is a schematic view illustrating the setting of unit-block by dividing a plurality of pixels of display panel to preset unit by a unit-block setting unit of driver IC device including correction function according to an exemplary embodiment of the present invention.

FIG. 3 is a schematic view illustrating the setting of unit-block by dividing a plurality of pixels of display panel into preset units by a unit-block setting unit of driver IC device including correction function according to an exemplary embodiment of the present invention.

As illustrated in FIG. 3, the display panel (200) may be configured by including a plurality of pixels, and the unit-block setting unit (110) may set the unit blocks by dividing the plurality of pixels by a preset unit. FIG. 3 illustrates the setting of unit blocks with a 2×2 block shape (form) in the unit-block setting unit (110) according to an exemplary embodiment of present invention, and may set the unit blocks in a 3×3 block shape, a 4×4 block shape or a 8×8 block shape according to another exemplary embodiment of present invention. Now, the unit block will, be explained in a 2×2 block shape for smooth explanation of present invention.

The correction route setting unit (120) may function to set a correction route (300) having a plurality of sub-regions (310) arranged in the same form in response to an arrangement of pixels included in the unit-blocks set through the unit-block setting unit (110). At this time, the correction route setting unit (120) may set one correction route (300) having a plurality of sub-regions (310) arranged in the same form in response to the arrangement of plurality of pixels included in the unit-blocks set through the unit-block setting unit (110). Here, the correction route (300) set through the correction route setting unit (120) may be configured to have a correction route coordinate value relative to each sub-region (310). The setting of correction route (300) in the correction route setting unit (120) will be described in more detail with reference to the following FIG. 4.

Figure 4:
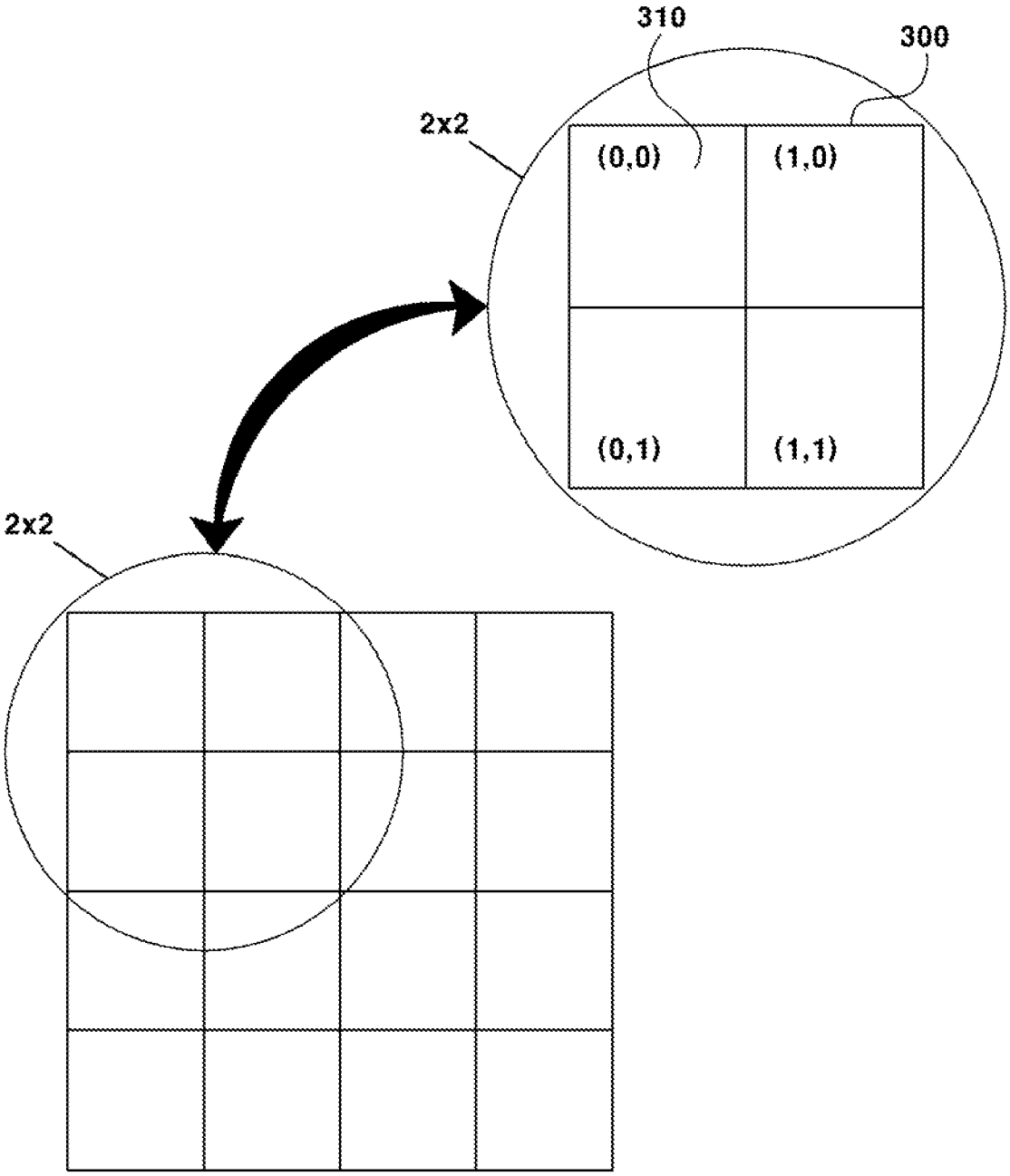
FIG. 4 is a schematic view illustrating a correction route corresponding to a unit-block set through a unit-block setting unit in a driver IC device including correction function according to an exemplary embodiment of present invention.

FIG. 4 is a schematic view illustrating a correction route corresponding to a unit-block set through a unit-block setting unit in a driver IC device including correction function according to an exemplary embodiment of present invention.

The correction route setting unit (120), as illustrated in FIG. 4, may set the correction route in response to the unit-blocks set through the unit-block setting unit (110). To be more specific, as shown in FIG. 4, when a unit-block is set in a 2×2 bock through the unit-block setting unit (110), the correction route setting unit (120) may set a correction route (300) with a 2×2 block form having four sub-regions (310). Here, a first sub-region disposed at an upper left in the four sub-regions (310) may be configured to have a correction route coordinate value of (0,0), a second sub-region disposed at an upper right may be configured to have a correction route coordinate value of (1,0), a third sub-region disposed at a lower left may be configured to have a correction route coordinate value of (0,1) and a fourth sub-region disposed at a lower right may be configured to have a correction route coordinate value of (1,1). Furthermore, in another exemplary embodiment, when a unit-block is set with a 3×3 block form through the unit-block setting unit (110), the correction route setting unit (120) may set a correction route (300) having a 3×3 block form having nine (9) sub-regions (310).

Furthermore, the correction route setting unit (120) in the exemplary embodiment may re-arrange each position of sub-region including a correction route coordinate value. For example, the first sub-region having a correction route coordinate value of (0,0) may be re-arranged to an upper left position, the third sub-region having a correction route coordinate value of (0,1) may be re-arranged to an upper right position, the fourth sub-region having a correction route coordinate value of (1,1) may be re-arranged to a lower left position, and the second sub-region having a correction route coordinate value of (1,0) may be re-arranged to a lower right position.

The storage unit (130) may function to store the correction route (300) set through the correction route setting unit (120), and to store each gain value and an offset value relative to the plurality of unit-blocks set through the unit-block setting unit (110). In the exemplary embodiment, the plurality of unit-blocks set through the unit-block setting unit (110) may have mutually different gain values and offset values, where the storage unit (130) may store each gain value and each offset value relative to the plurality of unit-blocks. Furthermore, the storage unit (130) may also store correction route coordinate value information relative to each sub-region (310) of correction route (300) set through the correction route setting unit (120) and the position information arranged with each sub-region (310).

Meantime, a changing unit (140, to be described later) may change an input value (input gray) inputted to a pixel of display panel (200) in response to a primary function (y=ax+b), where the gain value relative to the plurality of unit-blocks set through the unit-block setting unit (110) may mean a primary coefficient (a) in the given primary function and the offset value may mean a constant term (b) in the given primary function.

The changing unit (140) may change an input value (input gray) inputted to the pixels of the display panel (200), by using the gain values and offset values stored in the storage unit (130), Here, the changing unit (140) may change the input value (input gray) inputted to the pixels of display panel (200) to a real number-type gray value and an integer-type gray value. The process of changing, by the changing unit (140), the input value (input gray) inputted to the pixels of display panel (200) to a real number-type gray value and an integer-type gray value will be described in more detail in the following description.

As explained in the foregoing, the changing unit (140) may change the input value (input gray) inputted to the pixels of display panel (200) in response to the primary function (y=ax+b), where y value may mean a real number-type gray value and the primary coefficient a value may mean a gain value relative to a plurality of unit-blocks set through the unit-block setting unit (110), and the constant term b may mean an offset value.

That is, the real number-type gray value may be generated through the changing unit (140) by adding a value in which an input value (input gray) inputted to pixels within a unit-block and gain values to the unit-block stored in the storage unit are multiplied, to an offset value to the unit-block. For example, when input value (input gray) inputted to the pixel within the unit-block is 25, and a gain value relative to a relevant block is 1, and an offset value is 0.5, the real number-type gray value may be 25.5=(25×1+0.5).

Meantime, the real number-type gray value may be a real number value by excluding a decimal number from the real number-type gray value generated through the changing unit (140). For example, when the real number-type gray value generated by the changing unit (140) is 25.5, the real number-type gray value may be 25 excluded of the decimal number 0.5.

Figure 5:
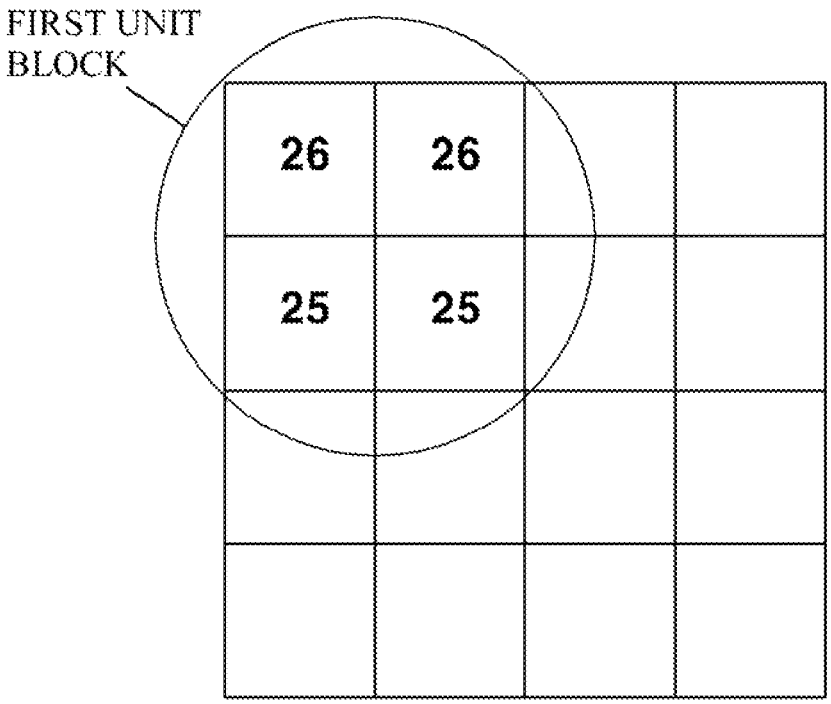
FIG. 5 is a schematic view illustrating a correction output value being outputted by allowing each pixel within a first unit-block to be corrected when it is presumed that the first unit-block is lit at 25.5 gray in a driver IC device including correction function according to an exemplary embodiment of present invention.
Figure 6:
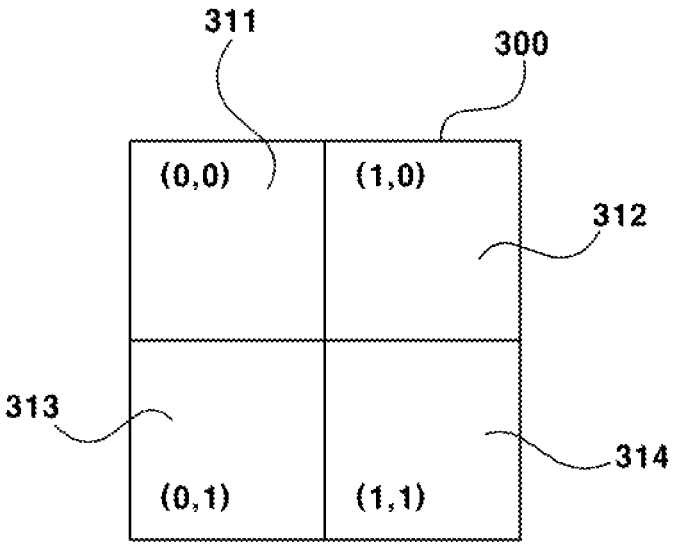
FIG. 6 is a schematic view illustrating a correction route having a plurality of sub-regions arranged in the same shape corresponding to a first unit-block in a driver IC device including correction function according to an exemplary embodiment of present invention.

The correction output unit (150) may function to generate a correction output value (output gray) within the unit-block of display panel by using the change value changed through the changing unit (140) and the coordinate value of correction route (300) set through the correction route setting unit (120). Here, the change value changed through the changing unit (140) may mean the real number-type gray value and the integer-type gray value. To be more specific, the correction output unit (150) according to the present invention may generate a correction output value (output gray) of pixel within a unit-block of display panel set using the following Equation 1, based on the change value that has changed the input value (input gray) inputted to the pixel within the unit-block through the changing unit, and a coordinate value of correction route set through the correction route setting unit. The correction of pixels within the unit-block of the display panel (200) through the correction output unit (150) will be explained in more detail with reference to FIGS. 5 and 6.

$$OG = \begin{cases} I_{gray} + 1, (F_{gray} - I_{gray}) \times BS > (I_y \times BHS + I_x) \\ I_{gray}, (F_{gray} - I_{gray}) \times BS \leq (I_y \times BHS + I_x) \end{cases} \quad \text{[Equation 1]}$$

where, OG: correction output value (output gray), BS: entire size of unit-block, BHS: crosswise size of unit-block, $F_{gray}$: real number type gray value, $I_{gray}$: integer type gray value, $I_x$: x coordinate value of correction route, $I_y$: y coordinate value of correction route FIG. 5 is a schematic view illustrating a correction output value being outputted by allowing each pixel within a first unit-block to be corrected when it is presumed that the first unit-block is lit at 25.5 gray in a driver IC device including correction function according to an exemplary embodiment of present invention, and FIG. 6 is a schematic view illustrating a correction route having a plurality of sub-regions arranged in the same shape corresponding to a first unit-block in a driver IC device including correction function according to an exemplary embodiment of present invention.

According to the exemplary embodiment, when the first unit-block is of 2×2 block form, an input value (input gray) inputted to the pixel within the first unit-block 25, a gain value relative to the first unit-block 1, and an offset value is 0,5, the real number type gray value (25×0.5) becomes 25.5, the integer-type gray value becomes 25, an entire size (2×2) of unit-block becomes 4, and a crosswise size of unit-block becomes 2, When the thus-derived value is inputted into the Equation 1, a correction output value of each pixel within the first unit-block may be generated, as shown in FIG. 5.

Hereinafter, a process of generating a correction output value of each pixel within the first unit-block illustrated in FIG. 5 will be explained in more detail. For smooth explanation, a pixel disposed at an upper left within the first unit-block is given as a first pixel, a pixel disposed at an upper right is given as a second pixel, a pixel disposed at a lower left is given as a third pixel and a pixel disposed at a lower right is given as a fourth pixel.

Furthermore, as illustrated in FIG. 6, a sub-region disposed at an upper left among the plurality of sub-regions within the correction route (300) arranged in a form corresponding to the first unit-block is called a first sub-region (311), a sub-region disposed at an upper right is called a second sub-region (312), a sub-region disposed at a lower left is called a third sub-region (313), and a sub-region disposed at a lower right is called a fourth sub-region (314). Furthermore, according to the exemplary embodiment, the first sub-region (311) may be configured to have a correction route coordinate value of (0,0), the second sub-region (312) disposed at the upper right may be configured to have a correction route coordinate value of (1,0), the third sub-region (313) disposed at a lower left may be configured to have a correction route coordinate value of (0,1), and the fourth sub-region disposed at a lower right (314) may be configured to have a correction route coordinate value of (1,1).

The process of generating a correction output value of first pixel through the Equation 1 may be explained as below: As explained before, because $F_{gray}$=25.5, $I_{gray}$=25, and a coordinate value of first sub-region (311) corresponding to the first pixel may be (0,0), such that $I_x$=0 and $I_y$=0. When these values are given to the Equation 1, because the value of (25.5−25)×4 is greater than the value of (0×2+0), the correction output value becomes 26 because of 25+1.

Based on the foregoing explanation, a process of generating a correction output value of second pixel may be given as below: Because $F_{gray}$=25.5, $I_{gray}$=25, $I_x$=1 and $I_y$=0, and value of (25.5−25)×4 is greater than the value of (0×2+1), the correction output value of second pixel becomes 26 because 25+1.

Likewise, a process of generating a correction output value of third pixel may be explained as below: Becuse $F_{gray}$=25.5, $I_{gray}$=25, $I_x$=0 and $I_y$=1, and the value of (25.5−25)×4 is same as the value of (1×2+0), the correction output value of third pixel becomes 25.

In the same method, a process of generating a correction output value of fourth pixel may be provided as under: Because $F_{gray}$=25.5, $I_{gray}$=25, $I_x$=1 and $I_y$=1, and the value of (25.5−25)×4 is smaller than the value of (1×2+1), a correction output value of fourth pixel becomes 25.

Figure 7:
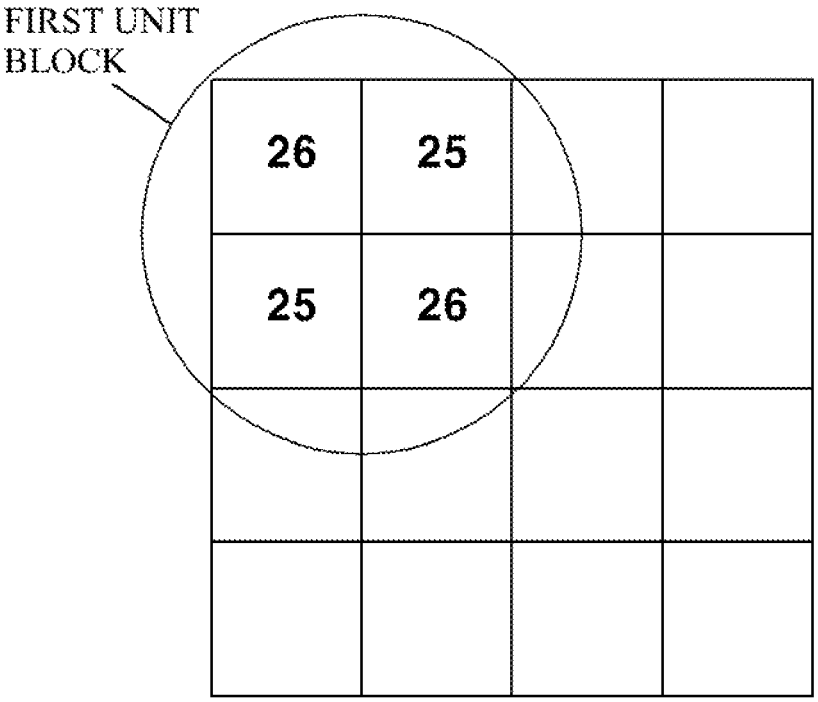
FIG. 7 is a schematic view illustrating a correction output value being outputted by allowing each pixel within a first unit-block to be corrected when it is presumed that the first unit-block is lit at 25.5 gray in a driver IC device including correction function according to another exemplary embodiment of present invention.

Meantime, according to another exemplary embodiment, when the first sub-region having a correction route coordinate value of (0,0) at the correction route setting unit (120) is arranged to be disposed at an upper left, the third sub-region having a correction route coordinate value of (0,1) is arranged to be disposed at an upper right, the fourth sub-region having a correction route coordinate value of (1,1) is arranged to be disposed at a lower left, and the second sub-region having a correction route coordinate value of (1,0) is arranged to be disposed at a lower right, each pixel within the first unit-block may be corrected as shown in FIG. 7 to indicate a correction output value.

As explained in the foregoing discussion, according to the driver IC device including a correction function proposed by the present invention, an output value of a pixel within a unit-block can be accurately corrected by correcting an output value of pixels within a unit-block, using respective gain values and offset values for the plurality of unit-blocks set by being divided to preset units, and a coordinate value of a correction route (LUT) having a plurality of sub-regions arranged in the same form in response to an arrangement of the pixels included in the unit-blocks.

Although the present disclosure has been explained with all constituent elements forming the exemplary embodiments of the present disclosure being combined in one embodiment, or being operated in one embodiment, the present disclosure is not limited thereto. That is, all elements may operate by allowing one or more elements to be selectively combined as long as within the scope of object of the invention.

Furthermore, terms such as "includes", "including", "have", "having", "comprises" and/or "comprising" as used herein mean that the relevant elements are embedded, unless otherwise described, such that the mentioned elements are not excluded but may be further included.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The foregoing explanations are intended only to be illustrative of the technical ideas of the present invention, and therefore, it should be appreciated by the skilled in the art that various modifications and amendments to the above examples may be made without deviating from the scope of protection of the invention. The exemplary embodiments disclosed by the present invention are not to limit the technical ideas of the present invention but to explain the present invention, and therefore, the technical ideas of present invention are not to be limited by the exemplary embodiments. The scope of protection of the present invention should be interpreted by the following claims and all technical ideas within the equivalent scope should be interpreted as being included in the scope of right of the present invention.

The invention claimed is:

1. A device for correcting an output value of a pixel included in a display, comprising:

a processor determining a plurality of unit-blocks by dividing a plurality of pixels included in the display into a preset unit, obtaining a gain value and an offset value relative to a unit-block included with the pixel among the plurality of unit-blocks, obtaining a real number-type gray value based on the gain value, the offset value and an input value relative to the pixel, and determining a correction output value of the pixel by comparing a first value determined by the real number-type gray value of the pixel and an integer portion of the real number-type gray value of the pixel with a second value determined by coordinate values of the pixel within a unit-block including the pixel and a size of the unit-block including the pixel; and a memory storing the determined correction output value of the pixel.

2. The device of claim 1, wherein the real number-type gray is determined through change of input value using the gain value and the offset value.

3. The device of claim 1, wherein the real number-type gray value is generated by adding a value, in which an input value inputted to pixels within a unit-block and gain values to the unit-block stored in the memory are multiplied, to an offset value to the unit-block.

4. The device of claim 1, wherein the first value is determined by a number of pixels included in the unit-block including the pixels.

5. The device of claim 1, wherein the first value is determined by a product of a number of pixels included in the unit-block including the pixel and a difference between the real number-type gray value of the pixel and the integer portion of the real number-type gray value of the pixel.

6. The device of claim 5, wherein the second value is determined by a sum of an x-coordinate value of the pixel and a product of a y-coordinate value of the pixel and the size of the unit-block including the pixel.

7. The device of claim 6, wherein the correction output value is the sum of the integer portion of the real number-type gray value of the pixel and 1 when the first value is greater than the second value.

8. The device of claim 6, wherein the correction output value is the integer portion of the real number-type gray value of the pixel when the first value is equal to the second value.

9. The device of claim 6, wherein the correction output value is the integer portion of the real number-type gray value of the pixel when the first value is less than the second value.

10. The device of claim 1, wherein the second value is determined by a sum of an x-coordinate value of the pixel and a product of a y-coordinate value of the pixel and the size of the unit-block including the pixel.

11. The device of claim 1, wherein the correction output value is the sum of the integer portion of the real number-type gray value of the pixel and 1 when the first value is greater than the second value.

12. The device of claim 1, wherein the correction output value is the integer portion of the real number-type gray value of the pixel when the first value is equal to the second value.

13. The device of claim 1, wherein the correction output value is the integer portion of the real number-type gray value of the pixel when the first value is less than to the second value.

* * * * *